US010343431B2

(12) United States Patent
Nihashi

(10) Patent No.: US 10,343,431 B2
(45) Date of Patent: Jul. 9, 2019

(54) PRINTER

(71) Applicant: TOSHIBA TEC KABUSHIKI KAISHA, Tokyo (JP)

(72) Inventor: Kiyotaka Nihashi, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/889,688

(22) Filed: Feb. 6, 2018

(65) Prior Publication Data

US 2018/0250965 A1 Sep. 6, 2018

(30) Foreign Application Priority Data

Mar. 1, 2017 (JP) ..... 2017-038717

(51) Int. Cl.
*B41J 29/02* (2006.01)
*B41J 15/04* (2006.01)
*B41J 29/13* (2006.01)

(52) U.S. Cl.
CPC ..... *B41J 29/02* (2013.01); *B41J 15/04* (2013.01); *B41J 29/13* (2013.01)

(58) Field of Classification Search
CPC ..... B41J 29/02; B41J 29/13; B41J 15/04
See application file for complete search history.

(56) References Cited

U.S. PATENT DOCUMENTS 8,303,200 B2 * 11/2012 Yokoyama ..... B26D 1/085 400/621
9,821,579 B2 * 11/2017 Sim ..... B41J 2/32
2007/0172289 A1 * 7/2007 Robinson ..... B41J 15/042 400/613
2008/0003038 A1 * 1/2008 Nihashi ..... B41J 2/32 400/188
2008/0003040 A1 * 1/2008 Sekino ..... B41J 3/60 400/188
2010/0086341 A1 * 4/2010 Yokoyama ..... B26D 1/085 400/621
2011/0146158 A1 6/2011 Yamada
2012/0224905 A1 * 9/2012 Nihashi ..... B41J 11/0075 400/583
2015/0202895 A1 * 7/2015 Nihashi ..... B41J 11/007 347/218
2017/0043599 A1 * 2/2017 Sim ..... B41J 2/32
2017/0144458 A1 * 5/2017 Nihashi ..... B41J 15/02

FOREIGN PATENT DOCUMENTS

EP 2174793 A1 4/2010
EP 3095610 A1 11/2016
JP 2007-055707 A 3/2007

OTHER PUBLICATIONS

Extended European Search Report dated Jul. 11, 2018, mailed in counterpart European Application No. 18153237.5, 10 pages.

* cited by examiner

*Primary Examiner* — Huan H Tran
(74) *Attorney, Agent, or Firm* — Kim & Stewart LLP

(57) ABSTRACT

A printer comprises a main body cover and an upper cover. The main body cover houses a roll paper, and an upper portion, the upper portion having an opening through which the roll paper can be loaded. The upper cover closes the opening of the main body cover, and has a gap in a direction in which at least one portion thereof intersects with an axial center of the roll paper housed in the main body cover with the main body cover.

19 Claims, 5 Drawing Sheets

PRINTER

CROSS-REFERENCE TO RELATED APPLICATION

This application is based upon and claims the benefit of priority from Japanese Patent Application No. 2017-038717, filed Mar. 1, 2017, the entire contents of which are incorporated herein by reference.

FIELD

Embodiments described herein relate generally to a printer for printing on a roll paper.

BACKGROUND

As a printer for printing on paper sheets, a technology is known for feeding a paper housed in a paper cassette and printing on the paper and then discharging the printed paper to a paper discharge tray. Further, with respect to the printer, a technology for feeding a roll paper housed in a main body cover and printing on the roll paper is known.

As the printer for printing on this roll paper, a technology is also known for rotatably mounting an upper cover on a box-shaped main body. It is known to rotate the upper cover between opened and closed positions to exchange a roll paper. Further, as a printer using a roll paper, a technology for cutting off a roll paper discharged by an operator after printing and a technology for automatically cutting off a discharged roll paper by a cutter arranged in the printer is also known.

DETAILED DESCRIPTION

In accordance to an embodiment, a printer comprises a main body cover and an upper cover. The main body cover houses a roll paper, and an upper portion, the upper portion having an opening through which the roll paper can be loaded. The upper cover closes the opening of the main body cover, and has a gap in a direction in which at least one portion intersects with an axial center of the roll paper housed in the main body cover with the main body cover.

Hereinafter, a printer 1 according to a first embodiment is described with reference to FIG. 1 to FIG. 3.

Figure 1:
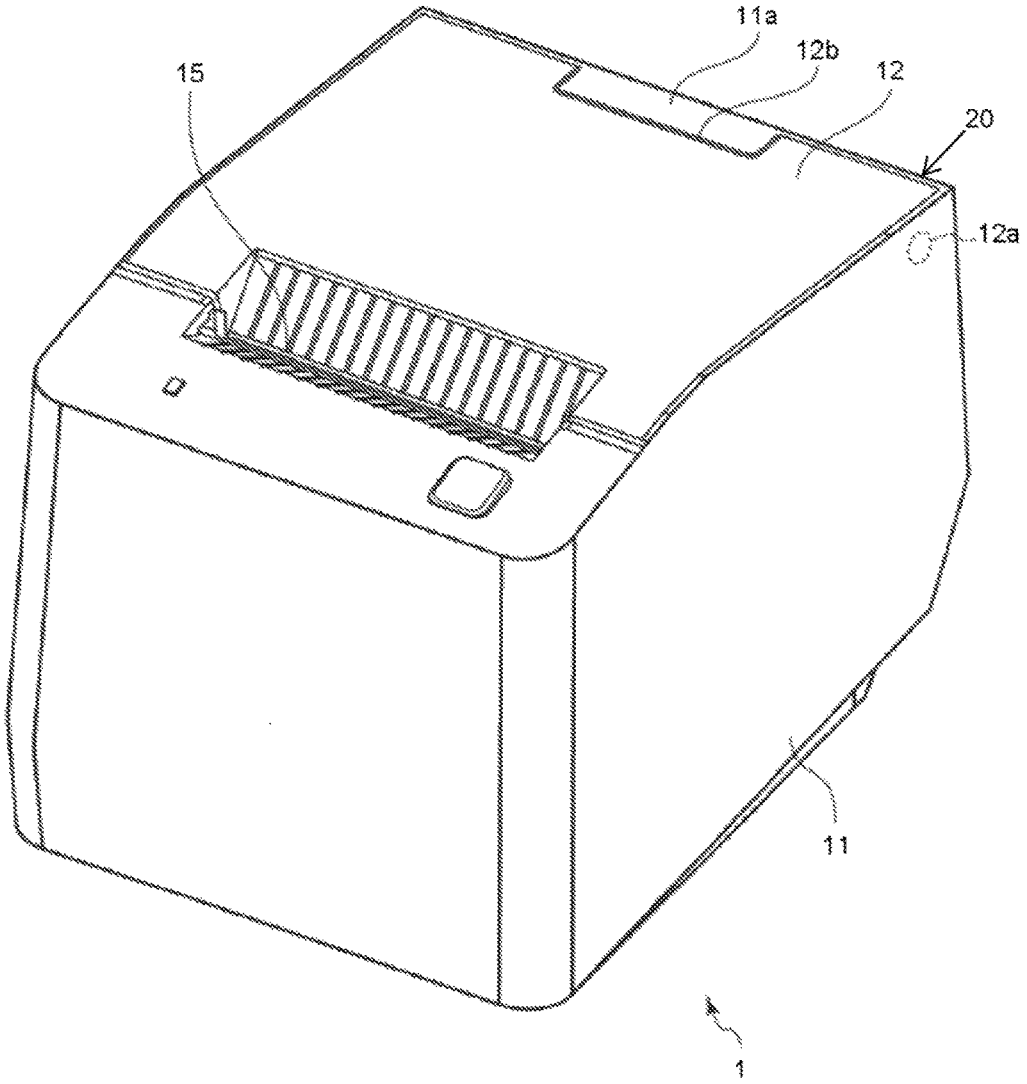
FIG. 1 is a perspective view of a printer according to a first embodiment.
Figure 2:
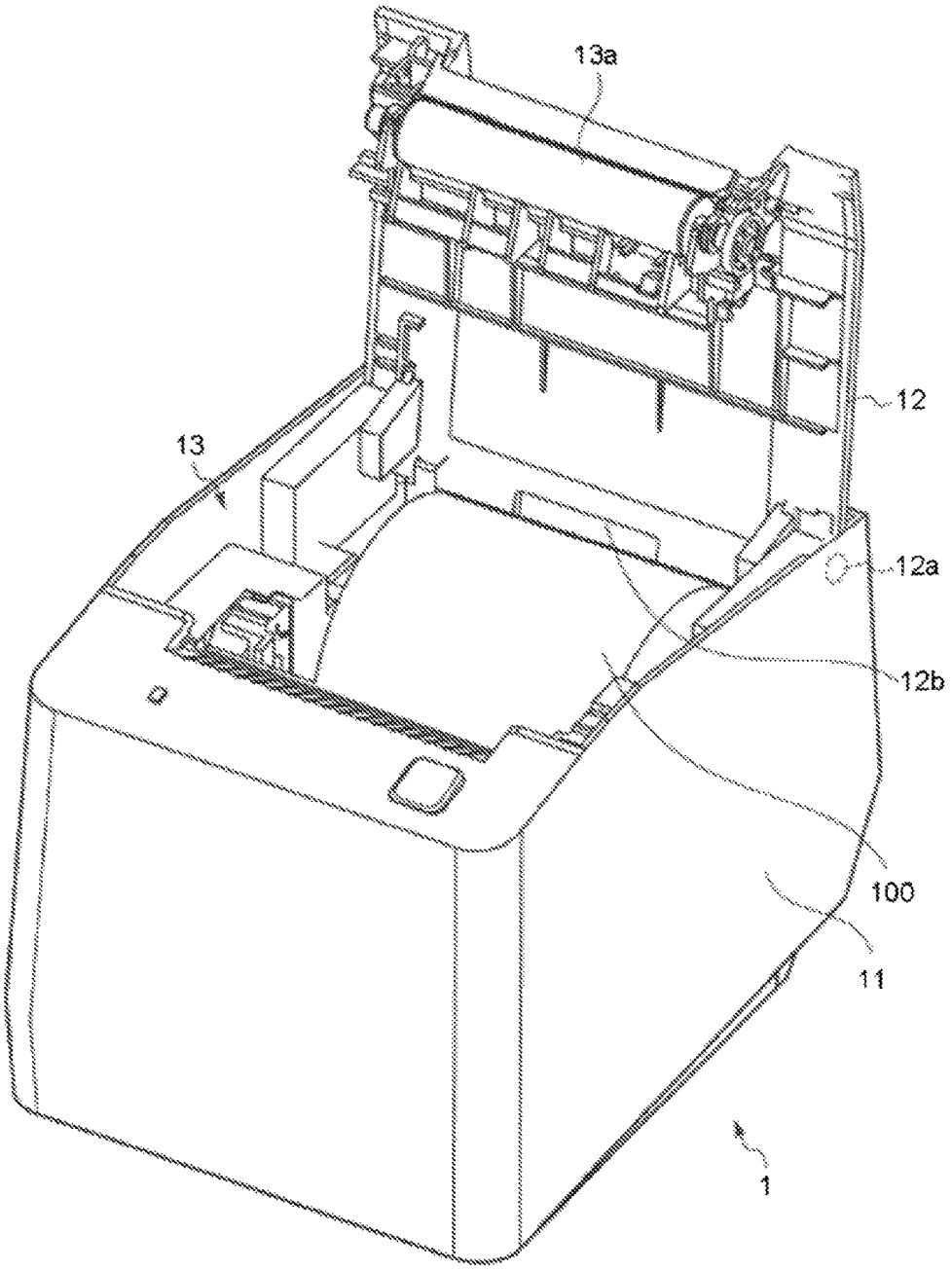
FIG. 2 is a perspective view of the same printer with an upper cover opened.
Figure 3:
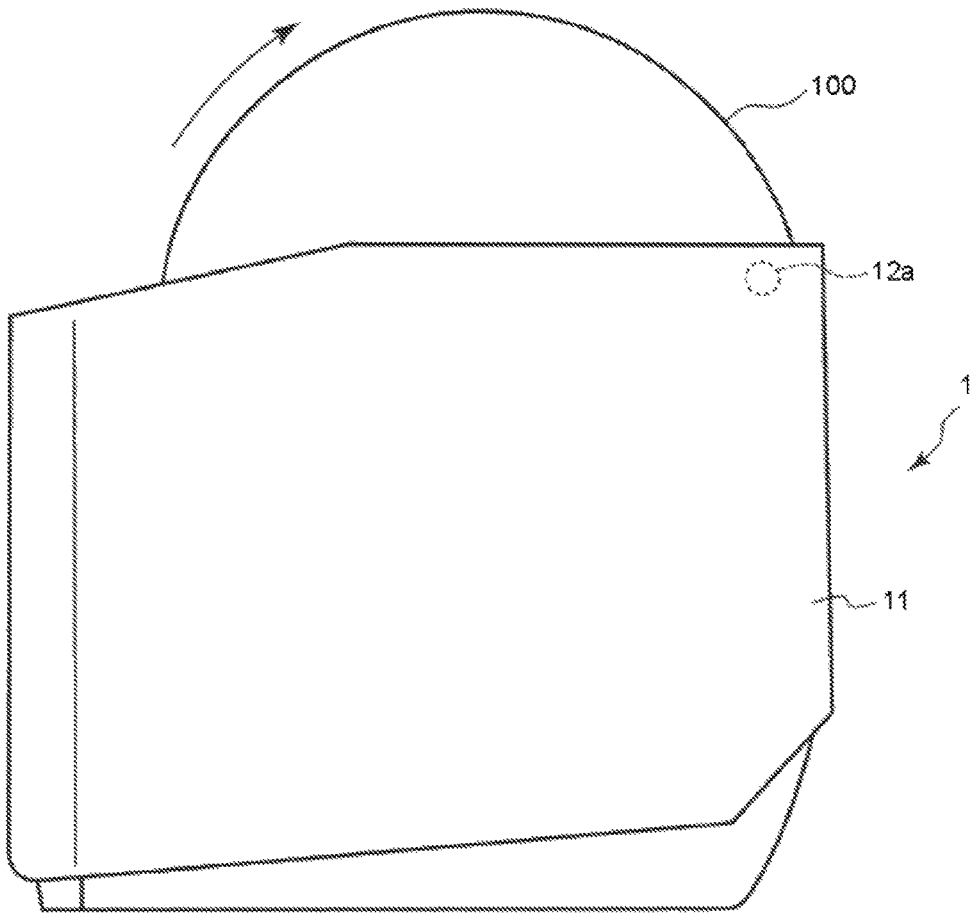
FIG. 3 is a side view of the same printer.

FIG. 1 is a perspective view of the printer 1 according to the first embodiment, FIG. 2 is a perspective view of the printer 1 and a state where an upper cover 12 is opened, and FIG. 3 is a view of the printer 1 and an example of a roll paper 100 discharged from a discharge port 15.

As shown in FIG. 1 and FIG. 2, the printer 1 includes a main body cover 11, the upper cover 12, and a printing mechanism 13. The printer 1 prints on the roll paper 100 housed in the main body cover 11, and then discharges the printed roll paper 100 from the discharge port 15. Herein, the roll paper 100 is formed by winding a belt-shaped paper into a roll shape on a winding core. For the roll paper 100, for example, a heat-sensitive paper is used, and then, the printer 1 is, for example, a thermal printer.

Furthermore, in the present embodiment, in a direction in which the front-back direction of the printer 1 is orthogonal to a rotational shaft of the roll paper 100, a side at which the discharge port 15 is arranged with respect to the center of the printer 1 is described as a front side, and an opposite side to the side is described as a back side (rear side) below. In other words, in FIG. 1, a surface at a left near side is described as a front surface of the printer 1 below.

The main body cover 11 is configured to have a rectangular box shape. An upper end of the main body cover 11 is configured to be opened, and the main body cover 11 houses the roll paper 100 loaded from the opening. The main body cover 11 has a front wall and a back wall along an axial direction of the roll paper 100 housed, and a pair of side walls along a direction orthogonal to the axial direction of the roll paper 100. The main body cover 11 has, on inner surfaces of the front wall, the back wall and the side walls, projections or ribs for mounting the printing mechanism 13.

The inner surface of the upper end of the back wall of the main body cover 11 protrudes in a direction in which the roll paper 100 is discharged.

As a specific example, the inner surface of the upper end of the back wall of the main body cover 11 has a protrusion 11*a* that has a rectangular plate shape and protrudes toward the front wall at the center side. Main body cover 11 at the back side thereof is parallel to the axial direction of the roll paper 100. The inner surface of the upper end of the back wall of the main body cover 11 has the protrusion 11*a* of the rectangular plate shape that protrudes toward the front wall. Thus, the main body cover 11 has at least protrusions in the inner surface of the upper end of the main body cover 11 in a direction orthogonal to the axial direction of the roll paper 100.

The upper cover 12 is disposed at the opening of the upper end of the main body cover 11 so as to be openable and closable. The upper cover 12 has a rotational shaft 12*a* rotatably supported on the main body cover 11. The rotational shaft 12*a* is located at a position lower than the upper end of the main body cover 11 and is rotatably supported on a pair of side walls separated from the back wall of the main body cover 11.

As shown in FIG. 1 to FIG. 3, the upper cover 12 is flush with the upper end of the main body cover 11 and blocks the opening of the main body cover 11 in the closed state. The upper cover 12 is separated from the inner surface of the upper end of the main body cover 11 at a predetermined gap in the closed state. In other words, a predetermined gap is provided between the main body cover 11 and the upper cover 12. For example, the upper cover 12 has a recess 12*b* in which the projection 11*a* of the main body cover 11 is disposed in the closed state.

The upper cover 12 constitutes the discharge port 15 of the roll paper 100 with the main body cover 11 in a gap 20 between the main body cover 11 and the upper cover 12 at a front side of the main body cover 11 in a closed state (shown in FIG. 1).

The upper cover 12 opens the main body cover 11 such that the roll paper 100 can be loaded in the main body cover 11 in an open state of the main body cover 11. The upper cover 12 is rotatable until it becomes upright in the open state (i.e., orthogonal to the position of the upper cover 12 in the closed state), for example. However, the upper cover 12 may be in a forward inclined position with respect to the erect position, and may rotate further with respect to the erect position (i.e., to incline further than the erect position). In other words, the opening degree of the upper cover 12 can be appropriately set as long as the roll paper 100 can be loaded in the main body cover 11 in the open state.

The printing mechanism 13 sends the roll paper 100 housed in the main body cover 11 to the discharge port 15, and prints the roll paper 100. For example, the printing mechanism 13 has a thermal head or platen roller 13*a*. The printing mechanism 13 is disposed inside the main body cover 11.

The discharge port 15 is arranged between the main body cover 11 and the upper cover 12. The discharge port 15 is an opening extending along the axial center of the roll paper 100. Further, a cutter used by an operator to cut off the roll paper 100 is arranged in the discharge port 15.

The printer 1 can prevent the situation where the roll paper 100 printed by the printing mechanism 13 and discharged from the discharge port 15 enters the gap 20 provided between the main body cover 11 and the upper cover 12 even if the roll paper 100 is curved and discharged to the rear as shown in FIG. 3.

More specifically, the discharge port 15 of the printer 1 is arranged at a front side of the upper surface of the printer 1 along the axial center of the roll paper 100. The roll paper 100 is wound on the winding core. If the roll paper 100 is discharged from the discharge port 15, the roll paper 100 is curved at a predetermine curvature radius. Thus, the roll paper 100 discharged from the discharge port 15 forward and upward, and moves towards a direction opposite to the discharge port 15 of the printer 1 as shown in FIG. 3. In the present embodiment, the roll paper 100 is discharged towards the back wall of the main body cover 11 and a rear edge portion of the upper cover 12. At this time, it is possible that the roll paper 100 moves towards the gap 20 provided between the back wall of the main body cover 11 and the rear edge portion of the upper cover 12. If the roll paper 100 enters the gap, it is possible to enter between the roll paper 100 housed inside and wound, and the back wall.

However, in the present embodiment, the protrusion 11*a* is included on the inner surface of the back wall of the main body cover 11, and the recess 12*b* is included in the rear edge portion of the upper cover 12, respectively. Thus, for the gap 20 provided between the main body cover 11 and the upper cover 12 at a back side of the printer 1, at least one portion of the gap 20 at a position opposite to the roll paper 100 is not along the axial center of the roll paper 100. In other words, for the gap 20 provided between the main body cover 11 and the upper cover 12 at the back side, at least one portion thereof with respect to a width direction of the roll paper 100 serving as the axial center of the roll paper 100 intersects with the width direction.

Further, in other words, for the gap 20 between the main body cover 11 and the upper cover 12 including the gap provided by the protrusion 11*a* and the recess 12*b*, at least one portion thereof extends in a direction intersecting with a longitudinal direction of an end portion of the roll paper 100. As a result, the protrusion 11*a* prevents the roll paper 100 from entering the inside of the main body cover 11 from the gap 20 between the main body cover 11 and the upper cover 12. Thus, the printer 1 can prevent an abnormal of paper discharge or jamming of the roll paper 100 caused by the winding of the roll paper 100 since the roll paper 100 enters the inside of the main body cover 11.

Further, the gap 20 is provided between the main body cover 11 and the upper cover 12 during manufacture; however, it is also considered to prevent the roll paper 100 from entering the gap 20 by reducing a width of the gap. However, a thickness of the roll paper 100 is about 0.07 mm. Thus, in order to reduce the gap, it is necessary to have high dimensional accuracy of the main body cover 11 and the upper cover 12 and to take shrinkage into consideration when the manufacture of the main body cover 11 and the upper cover 12 is molded with a resin material. From this, in order to reduce the gap, it is necessary to change a manufacture method of the printer 1, or it is possible to increase manufacture time or a project length. However, the printer 1 of the present embodiment can prevent the roll paper 100 from entering the gap 20 with a simple structure in which the protrusion 11*a* and the recess 12*b* are arranged in the main body cover 11 and the upper cover 12.

In accordance with the printer 1 according to the present embodiment as describe above, the roll paper 100 discharged can be prevented from entering the inside from the main body cover 11 and the upper cover 12.

Furthermore, the present embodiment is not limited to the example described above. In the example described above, a printer configuration in which the protrusion 11*a* is arranged at least in a portion of a range opposite to the roll paper 100 of the inner surface of the upper end of the main body cover 11 is described; however, the present embodiment is not limited to this. In other words, the printer 1 may be configured such that a direction in which the gap 20 extends is not along the axial direction of the roll paper 100 such that an end portion of the roll paper 100 does not enter the gap 20 between the main body cover 11 and the upper cover 12 at the back side.

Figure 4:
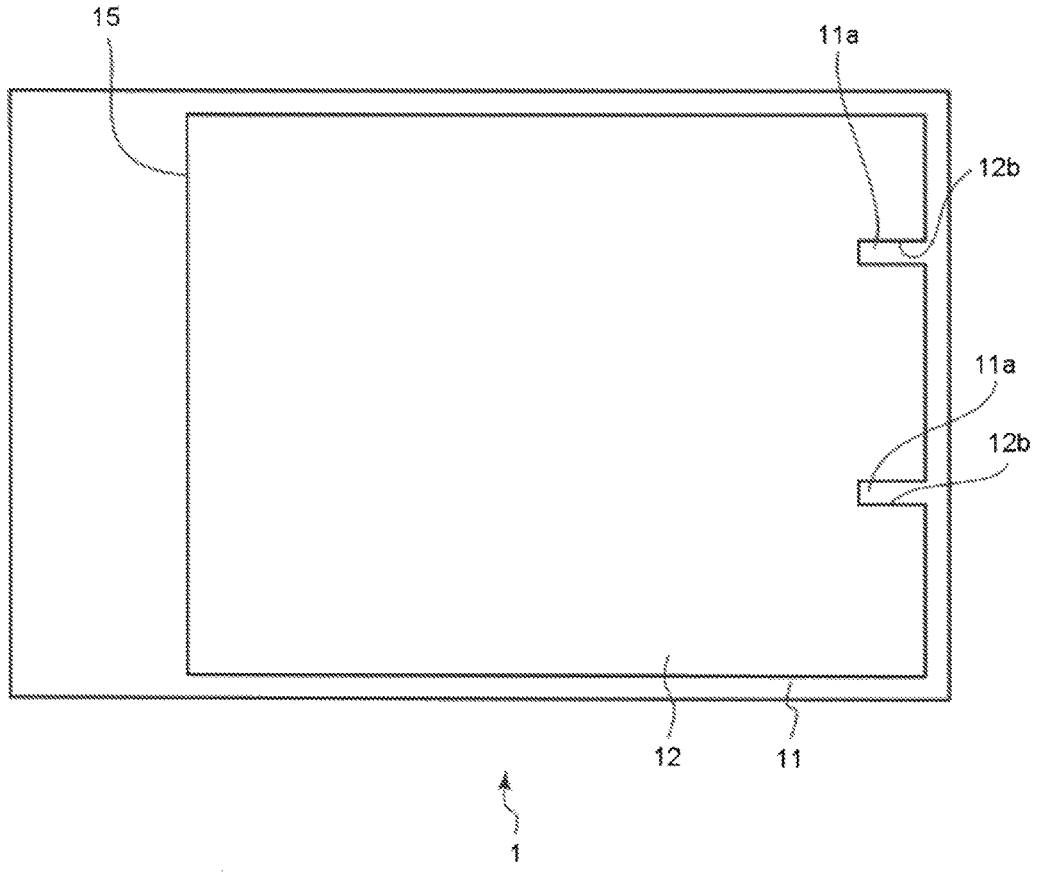
FIG. 4 is a plan view of a printer according to a second embodiment.
Figure 5:
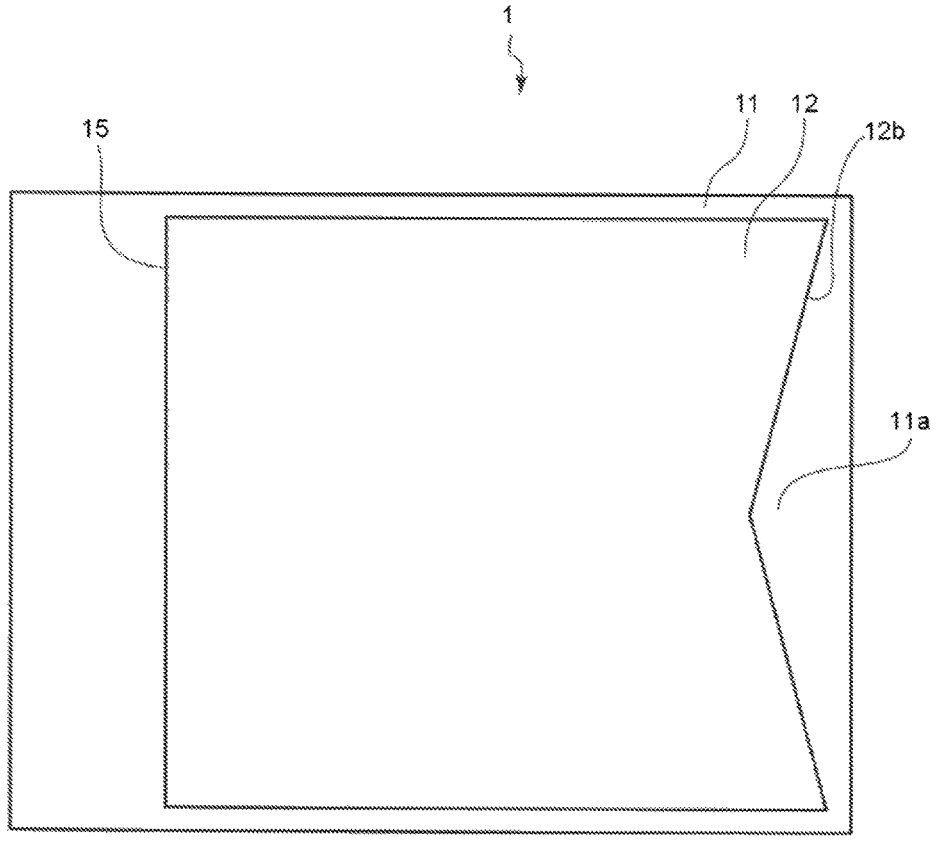
FIG. 5 is a plan view of a printer according to a third embodiment.

For example, as illustrated in a second embodiment shown in FIG. 4, the printer may be configured such that two rib-shaped protrusions 11*a* are arranged on the main body cover 11 in a range opposite to the roll paper 100, and recesses 12*b* having the same shape are arranged in the upper cover 12. Further, as illustrated in a third embodiment shown in FIG. 5, the printer may be configured such that the entire inner surface of the upper end of the main body cover 11 comprises a protrusion 11*a* having a peak between two angled surfaces extending toward the discharge port 15 side, and a recess 12*b* having the same shape is arranged in the upper cover 12.

Further, for example, in the example described above, a printer configuration in which the main body cover 11 is a rectangular box shape is described; however, the present embodiment is not limited to this. For example, the main body cover 11 may have a configuration in which each outer surface is constituted by a curved surface. Further, for example, the main body cover 11 may have a configuration in which a ridge section at the upper end side of the back wall is chamfered by an inclined surface. With such a configuration, the main body cover 11 can be guided such that the roll paper 100 discharged to the back wall side moves downward by a chamfering section.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a main body cover, wherein the main body cover houses a roll paper and an upper portion, the upper portion having an opening through which the roll paper can be loaded; and an upper cover configured to close the opening of the main body cover, the upper cover and the main body cover having a gap at a back side of the main body cover that is formed in a direction in which at least one portion thereof intersects with an axial center of the roll paper housed in the main body cover, wherein the upper cover is hingedly supported on the main body cover, and an upper surface of the upper cover is flush with an upper end of the main body cover when the upper cover in a closed state.

2. The printer according to claim 1, wherein the main body cover has a rectangular protrusion arranged on an inner surface of an upper end of the back side.

3. The printer according to claim 2, wherein the upper cover has a recess arranged on an edge portion that interfaces with the protrusion.

4. The printer according to claim 3, wherein the gap comprises the recess.

5. The printer according to claim 1, wherein the main body cover has a rib-shaped protrusion arranged on an upper end of the back side.

6. The printer according to claim 5, wherein the upper cover has a recess arranged on an edge portion that interfaces with the protrusion.

7. The printer according to claim 6, wherein the gap comprises the recess.

8. The printer according to claim 1, wherein the main body cover has a protrusion on an inner surface of an upper end of the back side, the protrusion being angled to intersect at a peak.

9. The printer according to claim 8, wherein the upper cover has a recess arranged on an edge portion that interfaces with the protrusion.

10. The printer according to claim 9, wherein the gap comprises the recess.

11. A printer, comprising:

a main body cover including an opening through which a roll paper can be loaded; and an upper cover hingedly supported on the main body cover, the upper cover being configured to close the opening of the main body cover, the upper cover and the main body cover forming a gap at a back side of the main body cover, at least one portion of the gap extending in a direction that intersects with an axial center of the roll paper housed in the main body cover, wherein an upper surface of the upper cover is flush with an upper end of the main body cover when the upper cover closes the opening of the main body cover.

12. The printer according to claim 11, wherein the main body cover has a rectangular protrusion arranged on an inner surface of an upper end of the back side.

13. The printer according to claim 12, wherein the upper cover has a recess arranged on an edge portion that interfaces with the protrusion.

14. The printer according to claim 13, wherein the gap comprises the recess.

15. The printer according to claim 11, wherein the main body cover has a rib-shaped protrusion arranged on an upper end of the back side.

16. The printer according to claim 15, wherein the upper cover has a recess arranged on an edge portion that interfaces with the protrusion.

17. The printer according to claim 16, wherein the gap comprises the recess.

18. The printer according to claim 11, wherein the main body cover has a protrusion on an inner surface of an upper end of the back side, the protrusion being angled to intersect at a peak; and the upper cover has a recess arranged on an edge portion that interfaces with the protrusion.

19. The printer according to claim 18, wherein the gap comprises the recess.

* * * * *